US012790968B2

(12) United States Patent
Park et al.

(10) Patent No.: US 12,790,968 B2
(45) Date of Patent: Nov. 10, 2026

(54) DEVICE FOR DETECTING DROP OF OIL PRESSURE

(71) Applicants: HYUNDAI MOTOR COMPANY, Seoul (KR); Kia Corporation, Seoul (KR)

(72) Inventors: Kihyoung Park, Hwaseong-si (KR); Jae Ik Ahn, Hwaseong-si (KR); Jaekyoung Jeong, Hwaseong-si (KR); Jaekyun Lee, Hwaseong-si (KR); Hyang Lee, Hwaseong-si (KR); Seong Gil Choi, Hwaseong-si (KR); Myung Rae Cho, Hwaseong-si (KR); Seongmin Lee, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 232 days.

(21) Appl. No.: 18/830,250

(22) Filed: Sep. 10, 2024

(65) Prior Publication Data

US 2025/0084776 A1 Mar. 13, 2025

(30) Foreign Application Priority Data

Sep. 12, 2023 (KR) ..... 10-2023-0120848

(51) Int. Cl.
*F01M 11/12* (2006.01)

(52) U.S. Cl.
CPC ..... *F01M 11/12* (2013.01); *F01M 2250/66* (2013.01)

(58) Field of Classification Search
CPC .. F01M 11/12; F01M 2250/66; F01M 11/064; F01M 11/10; F01M 1/16
See application file for complete search history.

(56) References Cited

U.S. PATENT DOCUMENTS

| | | | | |
|---|---|---|---|---|
| 6,266,587 | B1 * | 7/2001 | Guertler | F01M 11/10 701/29.5 |
| 2005/0039521 | A1 * | 2/2005 | Han | F01M 11/10 701/29.5 |
| 2023/0175421 | A1 * | 6/2023 | Bong | F01M 11/12 123/196 S |

* cited by examiner

*Primary Examiner* — Tarun Sinha
(74) *Attorney, Agent, or Firm* — Fish & Richardson P.C.

(57) ABSTRACT

A device configured to detect a drop of oil pressure includes: a first gate configured to receive an acceleration measured by an acceleration sensor and to output a logical value indicating whether the acceleration falls within a range that is determined by a turning cam tracking diagnosis entry acceleration and a turning cam tracking diagnosis escape acceleration; a second gate configured to invert an output of the first gate; and a third gate configured select and output one of an output value of the second gate or a first value based on a first selection signal. The device is configured to perform a turning cam tracking diagnosis entry when the output value of the third gate is the first value, and the device is configured to not perform the turning cam tracking diagnosis entry when the output value of the third gate is a second value.

13 Claims, 6 Drawing Sheets

DEVICE FOR DETECTING DROP OF OIL PRESSURE

CROSS-REFERENCE TO RELATED APPLICATION

This application claims priority to and the benefit of Korean Patent Application No. 10-2023-0120848, filed in the Korean Intellectual Property Office, on Sep. 12, 2023, the entire contents of which are incorporated herein by reference.

TECHNICAL FIELD

The present disclosure relates to a device for detecting drop of oil pressure.

BACKGROUND

An engine oil of a vehicle may perform various functions including reducing friction between parts in an engine, cooling the engine, maintaining the inside of the engine clean, preventing corrosion of the engine, and the like. In detail, the engine oil may produce a coating layer between moving parts in the engine, thus reducing the friction, preventing excessive wear of the part, and extending the efficiency and lifespan of the engine. In some cases, heat may occur in the engine while the engine is operated, and the engine may overheat and be damaged when this heat is excessively accumulated thereon. The engine oil may help cool the engine by absorbing and transferring heat from hot parts of the engine. In some cases, the engine oil may include an additive maintaining the inside of the engine clean by trapping and moving dirt, metal debris, or the like, and also include an anti-corrosion additive, thereby preventing corrosion of a metal part in the engine.

Detecting a drop of engine oil pressure of the vehicle may be important for safe operation of the engine. When the oil pressure drops, the friction between engine parts in the engine may be increased, which may cause the engine to be overheat or even be damaged.

SUMMARY

The present disclosure describes a device for detecting a drop of oil pressure which may improve a diagnostic condition to prevent an unnecessary turning cam tracking diagnosis entry even when the oil pressure does not actually drop during a turning operation of a vehicle under a condition where a remaining amount of engine oil (hereinafter referred to as "oil") is low.

According to one aspect of the subject matter described in this application, a device for detecting a drop of oil pressure includes: a first gate configured to receive an acceleration measured by an acceleration sensor and to output a logical value indicating whether the acceleration falls within a range that is determined by a turning cam tracking diagnosis entry acceleration and a turning cam tracking diagnosis escape acceleration; a second gate configured to invert an output of the first gate; and a third gate configured to select and output one of an output value of the second gate or a first value based on a first selection signal. The device is configured to perform a turning cam tracking diagnosis entry when an output value of the third gate is the first value, and the device is configured to not perform the turning cam tracking diagnosis entry when the output value of the third gate is a second value.

Implementations according to this aspect can include one or more of the following features. For example, the device may further include a fourth gate receiving centrifugal acceleration and outputting, as a logical value, a result of comparison of the centrifugal acceleration with a predetermined reference centrifugal acceleration value, wherein the first selection signal is the output of the fourth gate.

The centrifugal acceleration may have a value modeled based on a vehicle speed measured by a vehicle speed sensor and a steering angle measured by a steering angle sensor.

The predetermined reference centrifugal acceleration value may be 5 $m/s^2$.

The turning cam tracking diagnosis entry acceleration may be −3 $m/s^2$, and the turning cam tracking diagnosis escape acceleration may be −2 $m/s^2$.

The device may further include a fifth gate selecting and outputting one of the first value and the output of the third gate based on a second selection signal.

The device may perform the turning cam tracking diagnosis entry when the output value of the fifth gate is the first value, and the device may not perform the turning cam tracking diagnosis entry when the output value of the fifth gate is the second value.

The device may further include a sixth gate through which a predetermined value is capable of being recorded in a bit of a specified number, wherein the second selection signal is an output of the sixth gate.

According to another aspect, a device for detecting a drop of oil pressure includes: a first gate configured to perform a square calculation on a vehicle speed measured by a vehicle speed sensor; a second gate outputting an absolute value for a steering angle measured by a steering angle sensor; a third gate configured to perform a multiplication calculation on an output value of the first gate and the output value of the second gate; a fourth gate configured to perform a multiplication calculation on an output value of the third gate and a first type mapping value; a fifth gate configured to perform a square calculation on an output value of the fourth gate; a sixth gate configured to perform a multiplication calculation on an output value of the fifth gate and a second type mapping value; a seventh gate configured to perform a sum calculation on the output value of the second gate and an output value of the sixth gate; an eighth gate configured to perform a division calculation on the output value of the second gate and an output value of the seventh gate; and a ninth gate configured to perform a multiplication calculation on an output value of the eighth gate and the output value of the fourth gate, wherein the device determines whether to perform turning cam tracking diagnosis entry based on an output value of the ninth gate and acceleration measured by an acceleration sensor.

The device, in which the first type mapping value includes a left-turn mapping value and a right-turn mapping value, may further include a tenth gate selecting and outputting one of the left-turn mapping value and the right-turn mapping value based on a first selection signal.

The device may further include an eleventh gate outputting a different value based on a direction of the steering angle, wherein the first selection signal is the output of the eleventh gate.

The first type mapping value may be a value mapped based on a vehicle type.

The second type mapping value may be a value mapped based on the understeering or oversteering feature of a vehicle.

In order to generate a warning light to the driver, the turning cam tracking diagnosis may be required to be performed, and the number of error occurrences (indicating the poor cam tracking) may need to be a predetermined number or more. However, the error may be healed (i.e., the number of error occurrences may be reset to zero) when the normal decisions are accumulated although the acceleration enters the turning cam tracking diagnosis, and accordingly, the warning light may not be lighted on even when the warning light is supposed to lighted to the driver. In some implementations, the present disclosure may reduce the error healing, and provide the warning light to the driver at the more accurate time by improving the diagnostic condition to prevent the unnecessary turning cam tracking diagnosis entry as long as the oil pressure is actually high even though the oil tilt occurs when the vehicle turns under the condition where the remaining amount of oil is low.

DETAILED DESCRIPTION

Figure 1:
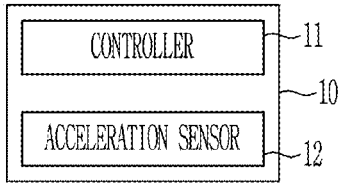
FIG. 1 is a block diagram for explaining an example of a device for detecting a drop of oil pressure.

Hereinafter, one or more implementations of the present disclosure will be described in detail with reference to the accompanying drawings so that those skilled in the art to which the present disclosure pertains may easily practice the present disclosure. As those skilled in the art would realize, the described implementations may be modified in various different ways, all without departing from the spirit or scope of the present disclosure. In addition, in the drawings, portions unrelated to the description are omitted to clearly describe the present disclosure, and similar portions are denoted by similar reference numerals throughout the specification.

FIG. 1 is a block diagram for explaining an example of a device for detecting drop of oil pressure.

In some implementations, Referring to FIG. 1, a device 10 for detecting a drop of oil pressure may include a controller 11 and an acceleration sensor 12. For example, the controller 11 may be an electronic control unit (ECU), and may control an overall operation of a vehicle, including detecting drop of engine oil pressure of the vehicle. The controller 11 may be implemented as a microcontroller-based computer, for example, a computing device described below with reference to FIG. 6. The controller 11 may function to monitor and control various functions of the vehicle, receive information from sensors, perform calculation based thereon, and give instructions to various parts. In some examples, the sensors may provide data on engine operation, fuel combustion, exhaustion, and the like. The controller 11 may include the plurality of ECUs, and the plurality of ECUs may communicate with each other through a communication network such as a controller area network (CAN) or a local interconnect network (LIN).

The acceleration sensor 12 may detect and monitor vehicle movement. For example, the acceleration sensor 12 may measure acceleration based on the vehicle acceleration, deceleration, direction change, and braking operations. In some examples, the acceleration sensor 12 may be implemented based on micro electro mechanical systems (MEMS) technology. The controller 11 may receive the vehicle acceleration measured by the acceleration sensor 12. In the present specification, 'acceleration' measured from the acceleration sensor 12 may refer to a longitudinal acceleration.

Hereinafter, with reference to FIG. 2, the description describes a logical flow showing a calculation process by the controller 11 of the device 10 for detecting drop of oil pressure to detect drop of oil pressure.

Figure 2:
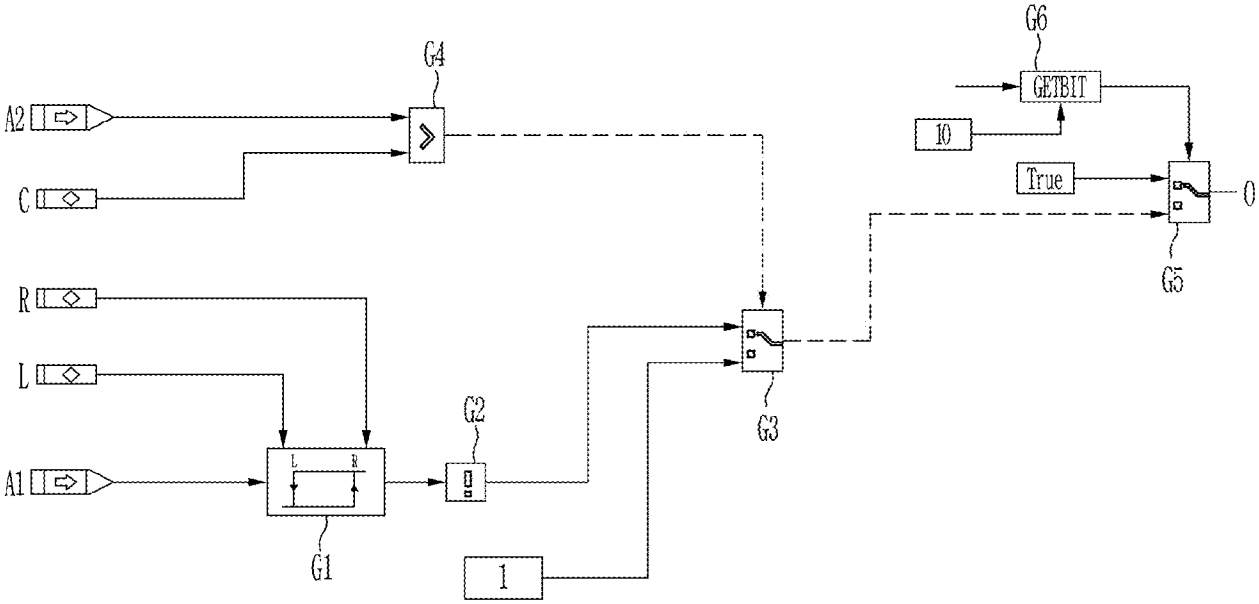
FIG. 2 is a view for explaining the device for detecting a drop of oil pressure of FIG. 1.

FIG. 2 is a view for explaining the device for detecting drop of oil pressure.

Referring to FIG. 2, the device 10 for detecting drop of oil pressure may include a plurality of gates G1 to G3.

The gate G1 may receive acceleration A1 measured by the acceleration sensor 12 and output, as a logical value, whether the acceleration A1 falls within a range determined by turning cam tracking diagnosis entry acceleration L and turning cam tracking diagnosis escape acceleration R. In some examples, the gate G1 may be a logic gate having a hysteresis feature. In some examples, the turning cam tracking diagnosis entry acceleration L may be $-3\ m/s^2$, and the turning cam tracking diagnosis escape acceleration R may be $-2\ m/s^2$. In this case, for example, the gate G1 may output a first value (true, T) when the acceleration A1 has a value of $2\ m/s^2$, and the gate G1 may output a second value (false, F) when the acceleration A1 has a value of $-3.5\ m/s^2$. The turning cam tracking diagnosis entry acceleration L or the turning cam tracking diagnosis escape acceleration R may be set to a different value based on specific implementation purpose or implementation environment.

The gate G2 may invert the output of the gate G1. In detail, the output of the gate G2 may be the second value (F) when the output of the gate G1 is the first value (T), and the output of the gate G2 may be the first value (T) when the output of the gate G1 is the second value (F).

The gate G3 may select and output one of the output value of the gate G2 and the first value T based on a first selection signal. In detail, the gate G3 may output the output value of the gate G2 as it is when the first selection signal has the second value (F), and the gate G3 may output the first value (T) when the first selection signal has the first value (T).

The device 10 for detecting drop of oil pressure may determine whether to perform turning cam tracking diagnosis entry based on an output value of the gate G3. In detail, the device 10 for detecting drop of oil pressure may perform the turning cam tracking diagnosis entry when the output value of the gate G3 is the first value (T), and may not perform the turning cam tracking diagnosis entry when the output value of the gate G3 is the second value (F).

The device 10 for detecting drop of oil pressure may further include a gate G4. In addition, the first selection signal input to the gate G3 may be an output signal of the gate G4.

The gate G4 may receive centrifugal acceleration A2, and output, as a logical value, a result of comparison of the centrifugal acceleration A2 with a predetermined reference centrifugal acceleration value C. In detail, the gate G4 may output the first value (T) when the centrifugal acceleration A2 has a value more than the predetermined reference centrifugal acceleration value C, and output the second value (F) when the centrifugal acceleration A2 has a value of the predetermined reference centrifugal acceleration value C or less. In some examples, the centrifugal acceleration A2 may have a value calculated through a predetermined mathematical equation by using a value acquired by the sensor detecting the vehicle movement, and a calculation method may be various. In some examples, the value of the centrifugal acceleration A2 may use a value calculated in an implementation of calculating a centrifugal acceleration value modeled based on a vehicle speed and a steering angle, which is described in detail below with reference to FIG. 4. In some examples, the predetermined reference centrifugal acceleration value C may be 5 $m/s^2$. In this case, for example, the gate G4 may output the first value (T) when the centrifugal acceleration A2 has a value of 6 $m/s^2$, and the gate G4 may output the second value (F) when the centrifugal acceleration A2 has a value of 3 $m/s^2$. The predetermined reference centrifugal acceleration value C may be set to a different value depending on the specific implementation purpose or implementation environment.

That is, the gate G1 may receive the vehicle acceleration A1, and the vehicle acceleration A1 may be an important consideration factor when determining the turning cam tracking diagnosis entry. However, the value of the first selection signal may be the first value (T) through the gate G4 if the centrifugal acceleration A2 has a predetermined level (that is, the predetermined reference centrifugal acceleration value C) or more. Accordingly, the gate G3 may output the first value (T), and the turning cam tracking diagnosis entry may thus be performed regardless of the value of the vehicle acceleration A1. In other words, in some examples, the centrifugal acceleration A2 of the vehicle may not reach a predetermined level. In some examples, the turning cam tracking diagnosis entry may be performed in a situation where the vehicle acceleration A1 has a value lower than a predetermined range (for example, a situation where the gate G1 outputs the second value (F), that is, a situation where the vehicle is driven and then turns during the deceleration). However, the turning cam tracking diagnosis entry may not be performed in a situation where the vehicle acceleration A1 has a value higher than the predetermined range (for example, a situation where the gate G1 outputs the first value (T), that is, a situation where the oil pressure does not easily drop due to high engine speed and high oil pump suction when the vehicle accelerates, such as a situation where the vehicle stops at an intersection and then starts to turn left). Accordingly, the present disclosure may prevent unnecessary turning cam tracking diagnosis entry as long as the oil pressure is actually high even though oil tilt occurs when the vehicle turns in a condition where a remaining amount of oil is low.

The device 10 for detecting drop of oil pressure may further include a gate G5 and a gate G6.

The gate G5 may select and output one of the first value (T) and the output of the gate G3 based on a second selection signal. In detail, the gate G5 may output the first value (T) when the second selection signal has the second value (F), and the gate G5 may output the output value of the gate G3 as it is when the second selection signal has the first value (T). In some examples, the second selection signal input to the gate G5 may be an output signal of the gate G6. A predetermined value may be recorded in a bit of a specified number through the gate G6. In some examples, the output of the gate G6 may be the second value (F), and the gate G5 may output the first value (T) when the predetermined value (for example, 'zero') is recorded in a bit 10 of the gate G6, and the output of the gate G6 may be the first value (T), and the gate G5 may output the output value of the gate G3 as it is when the predetermined value (for example, '1') is recorded in the bit 10 of the gate G6. That is, the turning cam tracking diagnosis entry may be performed regardless of the acceleration A1 and the centrifugal acceleration A2 when the predetermined value ('zero') is recorded in the bit of the specified number (for example, the bit 10) in the gate G6.

That is, the device 10 for detecting a drop of oil pressure may determine the turning cam tracking diagnosis entry based on the output value of the gate G5. In detail, the device 10 for detecting drop of oil pressure may perform the turning cam tracking diagnosis entry when the output value of the gate G5 is the first value (T), and may not perform the turning cam tracking diagnosis entry when the output value of the gate G5 is the second value (F).

In some implementations, the device 10 may not unconditionally perform the turning cam tracking diagnosis entry just because the oil tilt occurs, and perform the turning cam tracking diagnosis entry only when the oil tilt leads to the drop of the oil pressure. Accordingly, the device 10 may suppress an error healing occurring due to accumulated normal decisions although the acceleration enters turning cam tracking diagnosis, and provide the warning light to the driver at a more accurate time. In particular, in order to improve the accuracy of oil drop detection, the level of acceleration (longitudinal acceleration) is considered to determine whether to enter turning cam tracking diagnosis.

Figure 3:
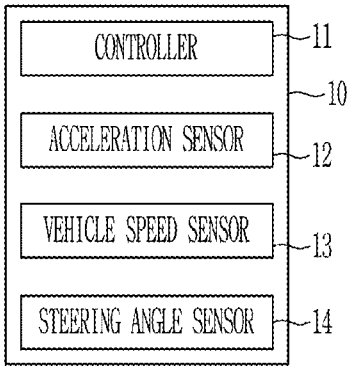
FIG. 3 is a block diagram for explaining an example of a device for detecting a drop of oil pressure.

FIG. 3 is a block diagram for explaining a device for detecting drop of oil pressure.

Referring to FIG. 3, the device 10 for detecting drop of oil pressure may include the controller 11, the acceleration sensor 12, a vehicle speed sensor 13, and a steering angle sensor 14. In some examples, general matters of the controller 11 and the acceleration sensor 12 may refer to the above descriptions of the controller 11 and the acceleration sensor 12 with reference to FIG. 1, and the description provided here thus omit redundant descriptions thereof.

The vehicle speed sensor 13 may measure the vehicle speed. In some examples, the vehicle speed sensor 13 may be installed on a transmission, or on a drive shaft or a vehicle wheel. The vehicle speed sensor 13 may be connected to a rotating part, and may calculate the vehicle speed by measuring a rotational speed of the corresponding part. In some examples, in the vehicle speed sensor 13, the rotating part connected to the device may generate a magnetic field, and the sensor 13 may be implemented as a magnetic vehicle speed sensor generating an electric signal as the magnetic field is changed. Alternatively, in some examples, in the vehicle speed sensor 13, the rotating part may have a window allowing light to pass therethrough and a window not allowing light to pass therethrough, disposed alternately with each other. In some examples, the vehicle speed sensor 13 may be implemented as an optical vehicle speed sensor calculating the vehicle speed by generating a signal and measuring a frequency for each time when light passes through the window allowing light to pass therethrough and light passes through the window not allowing light to pass therethrough. The controller 11 may receive the vehicle speed measured by the vehicle speed sensor 13.

The steering angle sensor 14 may detect how much a vehicle steering wheel rotates. In some examples, the steering angle sensor 14 may be installed around an axis of the steering wheel, and may measure the rotation of the steering wheel by using a rotary encoder or potentiometer. The controller 11 may receive the vehicle steering angle measured by the steering angle sensor 14.

Hereinafter, with reference to FIG. 4, the description describes a logical flow showing a process in which the controller 11 of the device 10 for detecting drop of oil pressure calculates the vehicle centrifugal acceleration modeled based on the vehicle speed measured by the vehicle speed sensor 13 and the steering angle measured by the steering angle sensor 14.

Figure 4:
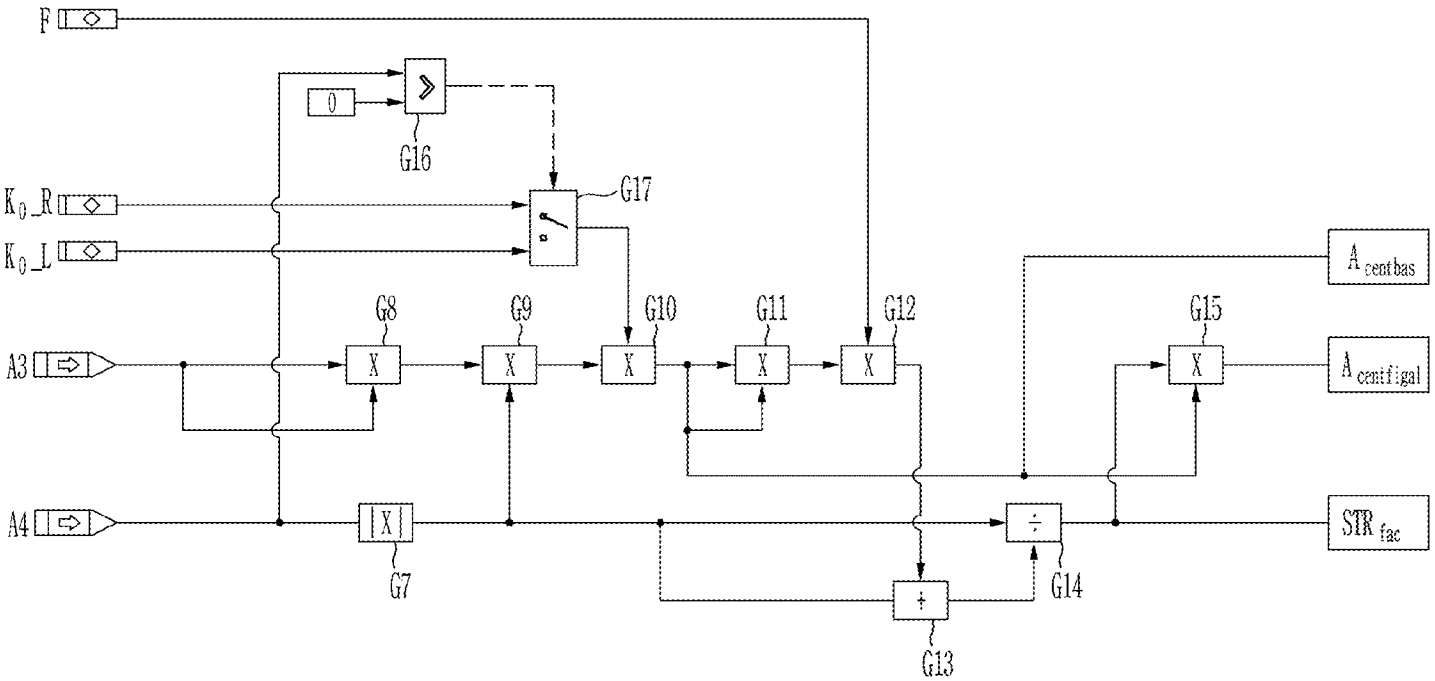
FIG. 4 is a view for explaining the device for detecting a drop of oil pressure of FIG. 3.

FIG. 4 is a view for explaining the device for detecting drop of oil pressure.

Referring to FIG. 4, the device 10 for detecting drop of oil pressure may include a plurality of gates G7 to G17. The device 10 for detecting drop of oil pressure may output, as centrifugal acceleration $A_{centfigal}$, a value modeled based on the vehicle speed measured by the vehicle speed sensor 13 and the steering angle measured by the steering angle sensor 14. The device 10 for detecting drop of oil pressure may determine whether to perform the turning cam tracking diagnosis entry based on the output centrifugal acceleration $A_{centfigal}$ and the acceleration A1 measured by the acceleration sensor 12, which may refer to the above description with reference to FIG. 2.

The gate G7 may output an absolute value for a steering angle A4 measured by the steering angle sensor 14, and the gate G8 may output a value acquired by performing square calculation on a vehicle speed A3 measured by the vehicle speed sensor 13. The gate G9 may output a value acquired by performing multiplication calculation on an output value of the gate G8 and an output value of the gate G7, and the gate G10 may output a value acquired by performing multiplication calculation on an output value of the gate G9 and a first type mapping value selected by the gate G17.

In some examples, the first type mapping value may include a left-turn mapping value $K_0$_L and a right-turn mapping value $K_0$_R, and the gate G17 may select one of the left-turn mapping value $K_0$_L and the right-turn mapping value $K_0$_R based on the first selection signal, and output one value to the gate G10.

In some examples, the first selection signal may be an output of the gate G11, which outputs a different value based on a direction of the steering angle A4. For example, the gate G11 may output the first value (T) when the value of the steering angle A4 is a positive value indicating that the vehicle turns left, and the gate G11 may output the second value (F) when the value of the steering angle A4 is a negative value indicating that the vehicle turns right. Accordingly, the gate G11 may output the left-turn mapping value $K_0$_L, when the first selection signal corresponds to the first value (T), and the gate G11 may output the right-turn mapping value $K_0$_R when the first selection signal corresponds to the second value (F). The first type mapping value, that is, the left-turn mapping value $K_0$_L or the right-turn mapping value $K_0$_R, may be a value mapped based on a vehicle type.

The gate G11 may output a value acquired by performing square calculation on an output value of the fourth gate G10, and the gate G12 may output a value acquired by performing multiplication calculation on an output value of the gate G11 and a second type mapping value (F). In some examples, the second type mapping value (F) may be a value mapped based on the understeering or oversteering feature of the vehicle. The second type mapping value (F) may be a positive value when having the understeering feature, and may be a negative value when having the oversteering feature.

The gate G13 may output a value acquired by performing sum calculation on the output value of the gate G7 and the output value of the gate G12, and the gate G14 may output a value acquired by performing division calculation on the output value of the gate G7 and an output value of the gate G13. The gate G15 may output a value acquired by performing multiplication calculation on an output value of the gate G14 and the output value of the gate G10, and the corresponding value may correspond to the centrifugal acceleration $A_{centfigal}$.

In some implementations, the present disclosure may model the vehicle speed and the steering angle based on a physical quantity directly related to the oil tilt, that is, the vehicle centrifugal acceleration, and implement the understeering or oversteering phenomenon that occurs as the vehicle speed is increased when the vehicle turns, thus improving accuracy of a centrifugal acceleration model.

Figure 5:
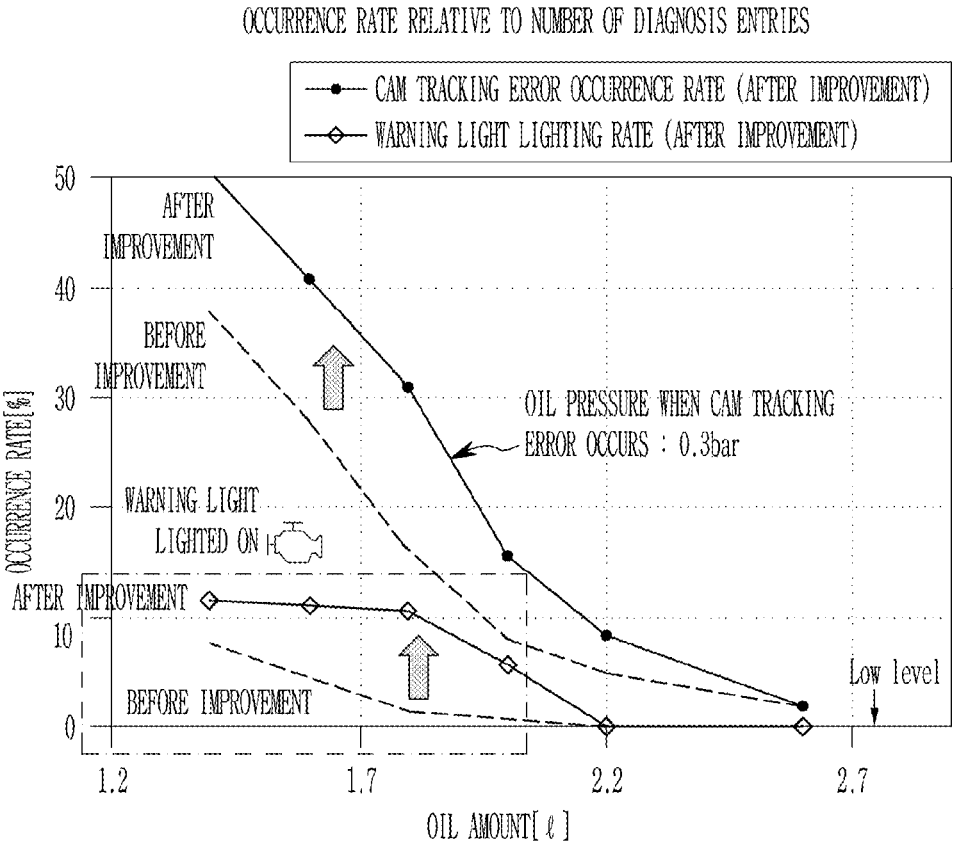
FIG. 5 is a view showing an example effect of improving a cam tracking error occurrence rate and a warning light lighting rate.

FIG. 5 is a view showing an example effect of improving a cam tracking error occurrence rate and a warning light lighting rate.

In some examples, referring to FIG. 5, it may be seen that the cam tracking error occurrence rate relative to the number of diagnostic entries is increased based on the same amount of oil as a result of applying the device for detecting drop of oil pressure according to the implementations. The reason is that the normal decision is made to suppress the error healing although the acceleration enters the turning cam tracking diagnosis. Likewise, it is shown that the warning light lighting rate relative to the number of diagnostic entries is also increased based on the same amount of oil. This improvement effect may be a result of improving the diagnostic condition to prevent the unnecessary turning cam tracking diagnosis entry as long as the oil pressure is actually high even though the oil tilt occurs when the vehicle turns under the condition where the remaining amount of oil is low.

Figure 6:
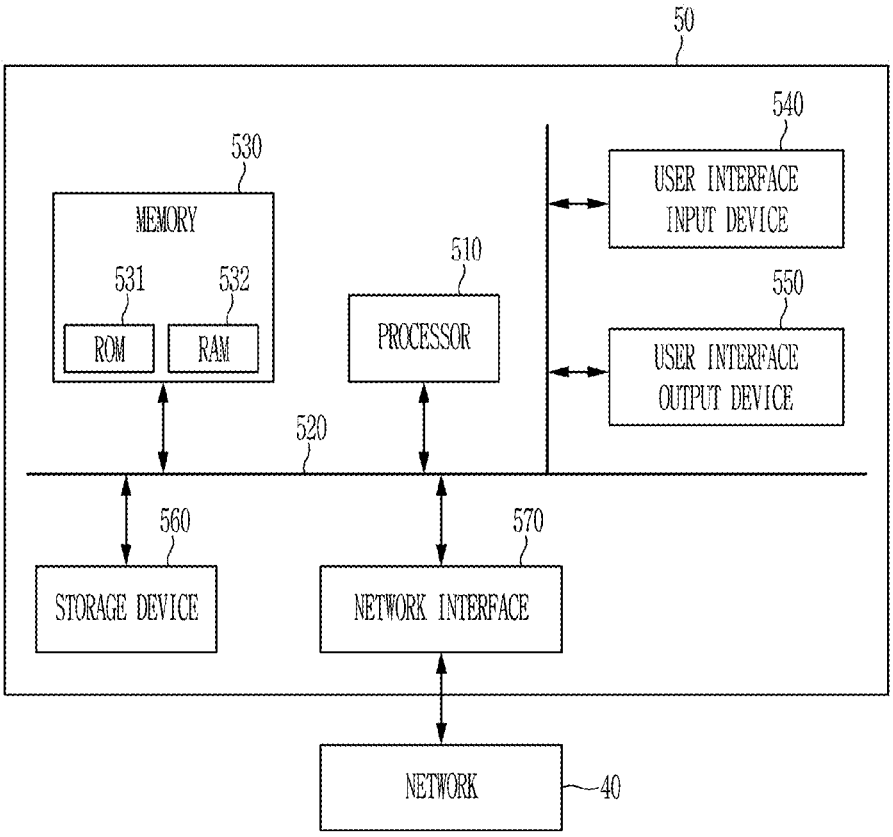
FIG. 6 is a view for explaining an example of a computing device.

FIG. 6 is a view for explaining the computing device.

Referring to FIG. 6, the device for detecting drop of oil pressure may be implemented using a computing device 50.

The computing device 50 may include at least one of a processor 510, a memory 530, a user interface input device 540, a user interface output device 550, and a storage device 560, performing communication through a bus 520. The computing device 50 may also include a network interface 570 electrically connected to a network 40. The network interface 570 may transmit or receive a signal with another entity through the network 40.

The processor 510 may be implemented in any of various types such as a micro controller unit (MCU), an application processor (AP), a central processing unit (CPU), a graphic processing unit (GPU), or a neural processing unit (NPU), and the memory 530 may be any semiconductor device executing an instruction stored in the storage device 560. The processor 510 may implement the functions and methods described above with respect to FIGS. 1 to 5.

The memory 530 and the storage device 560 may include various types of volatile or non-volatile storage media. For example, the memory may include a read only memory (ROM) 531 and a random access memory (RAM) 532. In some examples, the memory 530 may be disposed inside or outside the processor 510, and may be connected to the processor 510.

In some examples, at least some components or functions of the device for detecting drop of oil pressure may be implemented as a program or software implemented by the computing device 50, and the program or software may be stored in a computer-readable medium. In detail, the computer-readable medium may be a program for executing steps included in the method for detecting drop of oil pressure recoded on a computer including the processor 510 executing the program or instruction stored in the memory 530 or the storage device 560.

In some examples, at least some components or functions of the device for detecting drop of oil pressure according to the implementations may be implemented using hardware or circuitry of the computing device 50, or implemented using a separate hardware or circuitry that may be electrically connected to the computing device 50.

In some implementations, the present disclosure may not unconditionally perform the turning cam tracking diagnosis entry just because the oil tilt occurs, and perform the turning cam tracking diagnosis entry only when the oil tilt leads to the drop of the oil pressure. Accordingly, the present disclosure may suppress the error healing phenomenon occurring due to the accumulated normal decisions although the acceleration enters the turning cam tracking diagnosis, and provide the warning light to the driver at the more accurate time.

In addition, the present disclosure may model the vehicle speed and the steering angle based on a physical quantity directly related to the oil tilt, that is, the centrifugal acceleration of the vehicle, and implement the understeering or oversteering phenomenon that occurs as the vehicle speed is increased during the vehicle turning, thus improving the accuracy of the centrifugal acceleration model.

Although the implementations of the present disclosure have been described in detail hereinabove, the scope of the present disclosure is not limited thereto. That is, various modifications and alterations made by those skilled in the art by using a basic concept of the present disclosure as defined in the following claims fall within the scope of the present disclosure.

What is claimed is:

1. A device configured to detect a drop of oil pressure, the device comprising:

a first gate configured to receive an acceleration measured by an acceleration sensor and to output a logical value indicating whether the acceleration falls within a range that is determined by a turning cam tracking diagnosis entry acceleration and a turning cam tracking diagnosis escape acceleration;

a second gate configured to invert an output of the first gate; and a third gate configured to, based on a first selection signal, select and output one of (i) an output value of the second gate or (ii) a first value, wherein the device is configured to:

perform a turning cam tracking diagnosis entry based on the output value of the third gate being the first value, and not perform the turning cam tracking diagnosis entry based on the output value of the third gate being a second value different from the first value.

2. The device of claim 1, further comprising:

a fourth gate configured to receive a centrifugal acceleration and to output a logical value based on a comparison of the centrifugal acceleration with a predetermined reference centrifugal acceleration value, wherein the first selection signal is an output of the fourth gate.

3. The device of claim 2, wherein the centrifugal acceleration comprises a value that is modeled based on a vehicle speed measured by a vehicle speed sensor and a steering angle measured by a steering angle sensor.

4. The device of claim 2, wherein the predetermined reference centrifugal acceleration value is 5 $m/s^2$.

5. The device of claim 1, wherein the turning cam tracking diagnosis entry acceleration is −3 $m/s^2$, and the turning cam tracking diagnosis escape acceleration is −2 $m/s^2$.

6. The device of claim 1, further comprising:

a fifth gate configured to, based on a second selection signal, select and output one of (i) the first value or (ii) an output of the third gate.

7. The device of claim 6, wherein the device is configured to:

perform the turning cam tracking diagnosis entry based on an output value of the fifth gate being the first value; and not perform the turning cam tracking diagnosis entry based on the output value of the fifth gate being the second value.

8. The device of claim 6, further comprising:

a sixth gate through which a predetermined value is configured to be recorded in a bit of a specified number, wherein the second selection signal is an output of the sixth gate.

9. A device configured to detect a drop of oil pressure, the device comprising:

a first gate configured to perform a square calculation with a vehicle speed measured by a vehicle speed sensor;

a second gate configured to output an absolute value of a steering angle measured by a steering angle sensor;

a third gate configured to perform a multiplication calculation with an output value of the first gate and an output value of the second gate;

a fourth gate configured to perform a multiplication calculation with an output value of the third gate and a first type mapping value;

a fifth gate configured to perform a square calculation with an output value of the fourth gate;

a sixth gate configured to perform a multiplication calculation with an output value of the fifth gate and a second type mapping value;

a seventh gate configured to perform a sum calculation with the output value of the second gate and an output value of the sixth gate;

an eighth gate configured to perform a division calculation with the output value of the second gate and an output value of the seventh gate; and a ninth gate configured to perform a multiplication calculation with an output value of the eighth gate and the output value of the fourth gate, wherein the device is configured to determine whether to perform a turning cam tracking diagnosis entry based on an output value of the ninth gate and an acceleration measured by an acceleration sensor.

10. The device of claim 9, wherein the first type mapping value comprises a left-turn mapping value and a right-turn mapping value, wherein the device further comprises a tenth gate configured to select and output one of (i) the left-turn mapping value or (ii) the right-turn mapping value based on a first selection signal.

11. The device of claim 10, further comprising:

an eleventh gate configured to output different values based on a direction of the steering angle, wherein the first selection signal is an output of the eleventh gate.

12. The device of claim 9, wherein the first type mapping value is a value mapped based on a vehicle type.

13. The device of claim 9, wherein the second type mapping value is a value mapped based on an understeering or oversteering feature of a vehicle.

* * * * *